US010643802B2

(12) United States Patent
Hammer et al.

(10) Patent No.: US 10,643,802 B2
(45) Date of Patent: May 5, 2020

(54) SELECTOR FOR AN ON-LOAD TAP CHANGER AND ON-LOAD TAP CHANGER WITH LOAD TRANSFER SWITCH AND SELECTOR

(71) Applicant: Maschinenfabrik Reinhausen GmbH, Regensburg (DE)

(72) Inventors: Christian Hammer, Regensburg (DE); Alfred Bieringer, Geiselhoering (DE); Nikolaus Unterreiner, Regensburg (DE); Hubert Zwirglmaier, Regensburg (DE); Andreas Stocker, Neutraubling (DE)

(73) Assignee: MASCHINENFABRIK REINHAUSEN GMBH, Regensburg (DE)

( * ) Notice: Subject to any disclaimer, the term of this patent is extended or adjusted under 35 U.S.C. 154(b) by 0 days.

(21) Appl. No.: 16/080,679

(22) PCT Filed: Mar. 8, 2017

(86) PCT No.: PCT/EP2017/055391
§ 371 (c)(1),
(2) Date: Aug. 29, 2018

(87) PCT Pub. No.: WO2017/153447
PCT Pub. Date: Sep. 14, 2017

(65) Prior Publication Data

US 2019/0096596 A1 Mar. 28, 2019

(30) Foreign Application Priority Data

Mar. 11, 2016 (DE) ..... 10 2016 104 499

(51) Int. Cl.
*H01H 9/00* (2006.01)
*H01H 3/44* (2006.01)

(52) U.S. Cl.
CPC ..... *H01H 9/0016* (2013.01); *H01H 3/44* (2013.01); *H01H 9/0027* (2013.01)

(58) Field of Classification Search
CPC ..... H01H 9/0016; H01H 3/44; H01H 9/0027
(Continued)

(56) References Cited

U.S. PATENT DOCUMENTS 4,533,797 A 8/1985 Kranich, II et al.
6,060,669 A 5/2000 Dohnal et al.
(Continued)

FOREIGN PATENT DOCUMENTS

DE 9308424 U1 3/1994
EP 0907192 A2 4/1999

*Primary Examiner* — Edwin A. Leon
*Assistant Examiner* — Lheiren Mae A Caroc
(74) *Attorney, Agent, or Firm* — Leydig, Voit & Mayer, Ltd.

(57) ABSTRACT

A selector for an on-load tap changer with a diverter switch includes: an insulating plate with a first side and a second side, the second side opposite the first side; a plurality of fixed contacts, which extend from the first side through the insulating plate to the second side; a first movable contact on the first side; a second movable contact on the second side; a first connection, which is connected with the first movable contact and which is connectable with a first branch of the diverter switch; and a second connection, which is connected with the second movable contact and which is connectable with a second branch of the diverter switch. Each of the first moveable contact and the second movable contact are selectably connectable with each of the fixed contacts.

11 Claims, 9 Drawing Sheets

(58) Field of Classification Search
USPC ..... 200/11 TC
See application file for complete search history.

(56) References Cited

U.S. PATENT DOCUMENTS

| | | | | |
|---|---|---|---|---|
| 6,693,247 | B1 | 2/2004 | Byers et al. | |
| 6,833,518 | B1 * | 12/2004 | Byers | H01H 9/0027 200/11 TC |
| 2019/0066940 | A1 * | 2/2019 | Meyer | H01H 9/0027 |

* cited by examiner

SELECTOR FOR AN ON-LOAD TAP CHANGER AND ON-LOAD TAP CHANGER WITH LOAD TRANSFER SWITCH AND SELECTOR

CROSS-REFERENCE TO PRIOR APPLICATIONS

This application is a U.S. National Stage Application under 35 U.S.C. § 371 of International Application No. PCT/EP2017/055391 filed on Mar. 8, 2017, and claims benefit to German Patent Application No. DE 10 2016 104 499.7 filed on Mar. 11, 2016. The International Application was published in German on Sep. 14, 2017, as WO 2017/153447 A1 under PCT Article 21(2).

FIELD

The invention relates to a selector for an on-load tap changer and to an on-load tap changer with a diverter switch and a selector.

BACKGROUND

U.S. Pat. No. 6,693,247 B1 describes an on-load tap changer which functions according to the reactor switching principle. The on-load tap changer includes a base plate and a top plate, between which a motor, a transmission and the contact device are arranged. The fixed contacts are arranged circularly on the base plate and are connected by different contact units, which are actuated by way of the transmission. Contacting of the fixed contacts with the winding taps takes place on the rear side of the base plate. The transmission is fixed substantially to the top plate, which consists of steel.

SUMMARY

In an embodiment, a selector for an on-load tap changer with a diverter switch is provided that includes: an insulating plate with a first side and a second side, the second side opposite the first side; a plurality of fixed contacts, which extend from the first side through the insulating plate to the second side; a first movable contact on the first side; a second movable contact on the second side; a first connection, which is connected with the first movable contact and which is connectable with a first branch of the diverter switch; and a second connection, which is connected with the second movable contact and which is connectable with a second branch of the diverter switch. Each of the first moveable contact and the second movable contact are selectably connectable with each of the fixed contacts.

BRIEF DESCRIPTION OF THE DRAWINGS

The present invention will be described in even greater detail below based on the exemplary figures. The invention is not limited to the exemplary embodiments. Other features and advantages of various embodiments of the present invention will become apparent by reading the following detailed description with reference to the attached drawings which illustrate the following.

DETAILED DESCRIPTION

Figure 1:
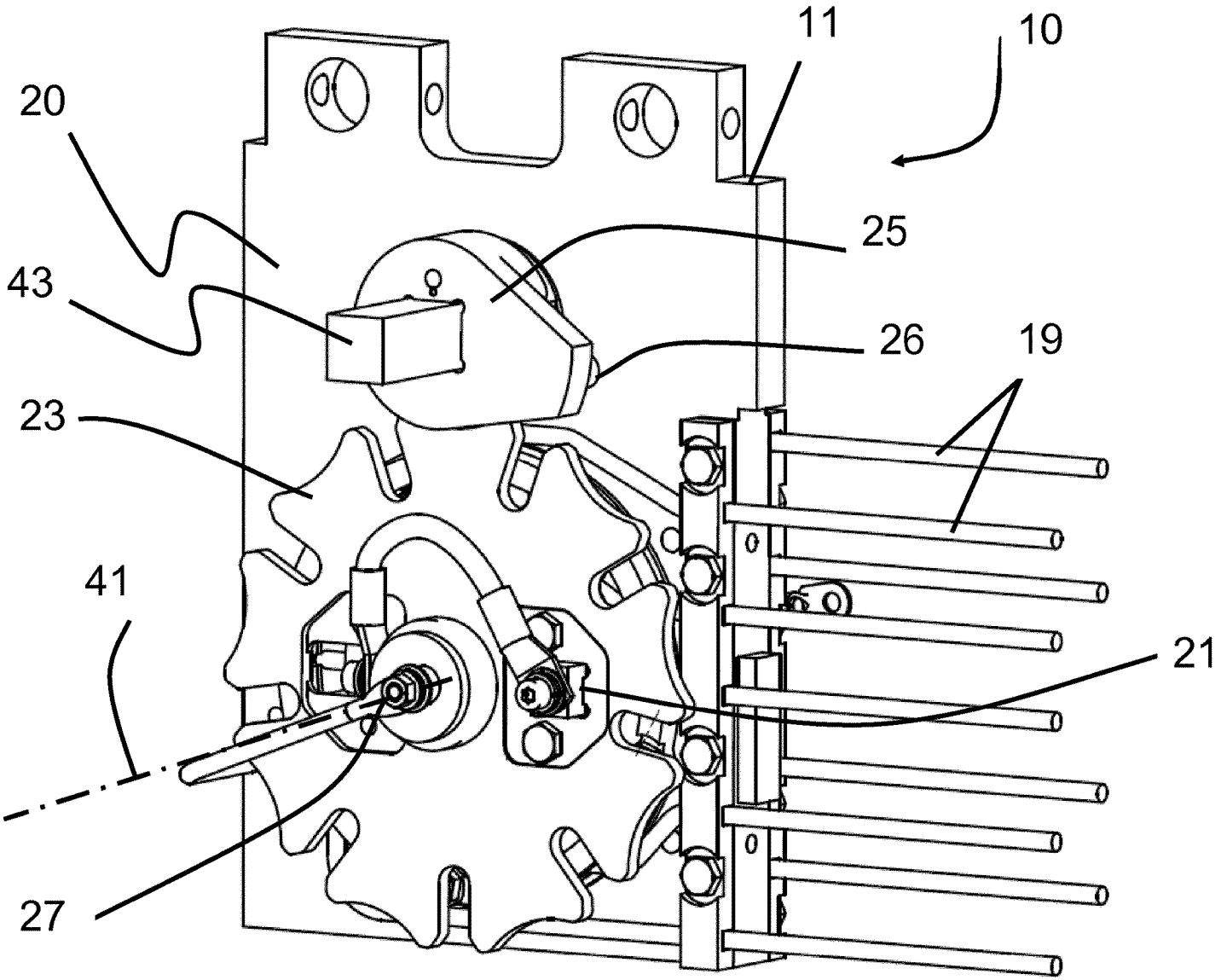
FIG. 1 shows a first side of a preferred form of embodiment of a selector for an on-load tap changer with diverter switch.

In the following, an expression of the kind "A is joined to B" corresponds with an expression of the kind "A is connected with B", an expression of the kind "A is connected with B" embraces the meanings "A is directly electrically conductively connected with B" and "A is indirectly, thus by way of C, electrically conductively connected with B", and an expression of the kind "A is attached to B" has the meaning "A is directly electrically conductively connected with B".

According to an embodiment of the present invention a selector is provided for an on-load tap changer with a diverter switch, that includes: an insulating plate with a first side and a second, opposite side; a plurality of fixed contacts which extend from the first side through the insulating plate to the second side; a first moved contact on the first side; a second moved contact on the second side; first connection, which is connected with the first moved contact and which can be connected with a first branch or load branch of the diverter switch; and a second connection, which is connected with the second moved contact and which can be connected with a second branch or load branch of the diverter switch. Each moved contact can be selectable connected with each of the fixed contacts.

By virtue of the fixed contacts extending through from the first side to the second side, this selector makes it possible for the two moved contacts to contact a fixed contact at the same time in the stationary state. The entire on-load tap changer thus lies at a defined potential and thereby has a high level of surge voltage resistance.

Due to the fewer components, this selector is economic, but nevertheless reliable. All parts of the selector are secured to only one insulating plate. This particularly space-saving configuration makes it possible to substantially reduce the constructional size for the corresponding transformer, which is constructed as, for example, a local mains transformer. This fact reduces the overall cost of the system. In addition, this simple construction makes possible particularly rapid assembly of the selector. The fixed contacts are easily insertable into the insulating plate. In addition, the attachment of the moved contacts can be carried out simply, since these are easy to mount from each side.

Each fixed contact can be joined or attached to a winding tap, which is associated therewith, of a regulating winding of a transformer or a regulable coil.

The moved contacts and fixed contacts are constructed in such a way that each moved contact can be selectably connected with each of the fixed contacts.

This selector can be constructed in any mode and manner according to requirements, for example in such a way that it includes at least one or no additional insulating plate and/or at least one or no additional moved contact and/or at least one or no additional connection.

For preference it is specified that each fixed contact has a first contact region for the first moved contact on the first side and a second contact region for the second moved contact on the second side.

The contact regions of the fixed contacts correspond with the geometry of the moved contacts and thus ensure an electrically conductive connection, which is, in particular, mechanically positive in nature. The contact regions in that case can be constructed as, for example, simple straight or curved pins.

For preference it is specified that the selector includes: a first Geneva wheel which is mounted on the insulating plate to be rotatable about an axis and which carries the first moved contact; and a second Geneva wheel, which is mounted on the insulating plate to be rotatable about the axis and which carries the second moved contact. The axis extends perpendicularly to the two sides of the insulating plate.

In that case, each moved contact can be fastened to the respective Geneva wheel by additional means, such as compression and/or tension springs, so as to ensure a movable or floating mounting. The bearing axles can be constructed as separate individual parts or as a part which is injection-moulded onto the insulating plate.

It is preferably specified that the selector includes: a first driver on the first side and a second driver on the second side; and a common drive shaft, which extends through the insulating plate and the driver and which is rotatably mounted on the insulating plate. The two drivers are driven by the drive shaft. The first driver has a first cam and the second driver has a second cam. Each cam engages in the respective Geneva wheel so that for a complete revolution of a driver the respective Geneva wheel rotates only through a fraction of a complete revolution.

The driver can include, according to requirements, additional cams so that, in the case of rotation of a driver through 360°, the respective Geneva wheel is actuated correspondingly frequently. The selector can, according to requirements, include at least one or no additional drive shaft.

For preference it is specified that the first cam is arranged to be displaced relative to the second cam so that an alternating actuation of the Geneva wheels takes place.

In that case the drivers and thus the cams arranged thereat are offset at an angle relative to one another. The angle is in that case of such a size that an offset actuation of the individual moved contacts takes place.

It is preferably specified that the connections are connected with the moved contacts directly or by way of a wire; and/or the connections are connected with a contact shaft and/or a contact ring; and/or each moved contact is of single-part or multi-part construction; and/or each moved contact is movably mounted on the respective Geneva wheel; and/or each fixed contact is connected with a line or is constructed integrally with a line as a curved conductor.

The fixed contact and the line can be connected by soldering, welding or other joining method. However, the two parts can also consist of a wire which through deforming at an end has two contact regions for the moved contacts.

For preference it is specified that the lines are secured to the insulating plate by means of a holding ring and/or a securing rail; and/or the lines are clipped to, plugged onto, detented in or snap-fitted in the insulating plate; and/or the lines are embedded in or injection-moulded around or injection-moulded in or fused into the insulating plate.

The embedding of the lines in the insulating plate can be carried out in any desired mode and manner according to requirements, for example by injection-moulding or low-pressure casting.

For preference it is specified that the first Geneva wheel is rotatably mounted on a first bearing axle; and the second Geneva wheel is rotatably mounted on a second bearing axle.

It is preferably specified that the bearing axles and the insulating plate are of integral construction.

According to a second aspect the invention proposes an on-load tap changer including a selector which is constructed in accordance with the first aspect; and a diverter switch with a first load branch or branch which is joined or attached to the first connection and a second load branch or branch which is joined or attached to the second connection.

For preference it is specified that the diverter switch is connected with ground potential by way of load diverting means.

The explanations with respect to one of the aspects of the invention, particularly to individual features of this aspect, correspondingly also apply in analogous manner to the other aspects of the invention.

Forms of embodiment of the invention are explained in more detail in the following by way of example with reference to the accompanying drawings. However, the individual features evident therefrom are not confined to the individual forms of embodiment, but can be connected and/or combined with further above-described individual features and/or with individual features of other forms of embodiment. The details in the drawings are to be understood as merely explanatory, but not limiting. The reference numerals present in the claims are not to restrict the scope of protection of the invention in any way, but refer merely to the forms of embodiment shown in the drawings.

A preferred form of embodiment of a selector 10 with an insulating plate 11 is illustrated in FIGS. 1 to 4. The insulating plate 11 consists of an insulating material such as, for example, plastic or fibre-reinforced plastic (for example, a mixture of polyamide or polyphthalamide with glass fibres). The insulating plate 11 is, for example, substantially rectangular and has a first side 20 and a second, opposite side 30. A plurality of fixed contacts 18, which are connected by way of lines 19 with winding taps of a regulating winding 17 (FIG. 9) of a tapped transformer and are constructed in accordance with a first form of embodiment, is arranged on the first side 20. The fixed contacts 18 extend from the first side 20 through the insulating plate 11 to the second side 30. The fixed contacts 18 preferably consist of copper and are, in addition, silvered. Moreover, a first Geneva wheel 23 with a first movable contact 21 movably mounted thereon is mounted on the first side 20 of the insulating plate 11. The first Geneva wheel 23 is mounted on a first bearing axle 24 to be rotatable about an axis 41. The bearing axle 24 is constructed as, for example, a separate part mechanically connected with the insulating plate 11. However, the bearing axle 24 can, at the time of production of the insulating plate 11, be injection-moulded thereon and constructed together with this as a unit. A first driver 25 is arranged near the first Geneva wheel 23 and is actuated by way of a drive shaft 43 which extends through the insulating plate 11. In that case, the first drive 25 has a first cam 26 which engages in the first Geneva wheel 23 and thus rotates this.

On actuation of the selector 10, the first drive 25 is rotated by corresponding actuation of the drive shaft 43 through 360°. On co-operation with the first Geneva wheel 23, in the case of a complete revolution of the first driver 25, the first Geneva wheel 23 is rotated only in part, thus through a fraction of a full revolution. By virtue of the combination of the first driver 25 and the first Geneva wheel 23, the continuous rotational movement of the first driver 25 is converted into a stepped or piece-by-piece rotation of the first Geneva wheel 23. The combination of a Geneva wheel 23 and a driver 25 enables a blocking function of the two parts relative to one another even in the rest state, thus prior to or after actuation of the selector 10.

Prior to actuation of the first Geneva wheel 23, the first moved contact 21 always contacts one of the fixed contacts 18 and in that case electrically conductively connects this with a first connection 27 (FIG. 9) of a first branch 12 of the diverter switch 14. When the selector 10 is actuated, the first Geneva wheel 23 is rotated and in that case the first moved contact 21 is switched over from this fixed contact 18 to an adjacent fixed contact 18.

Each fixed contact 18 has a first contact region 22 and a second region 32. Contacting of the fixed contacts 18 with the first moved contact 21 takes place on the first side 20 by way of the respective first contact region 22.

Figure 2:
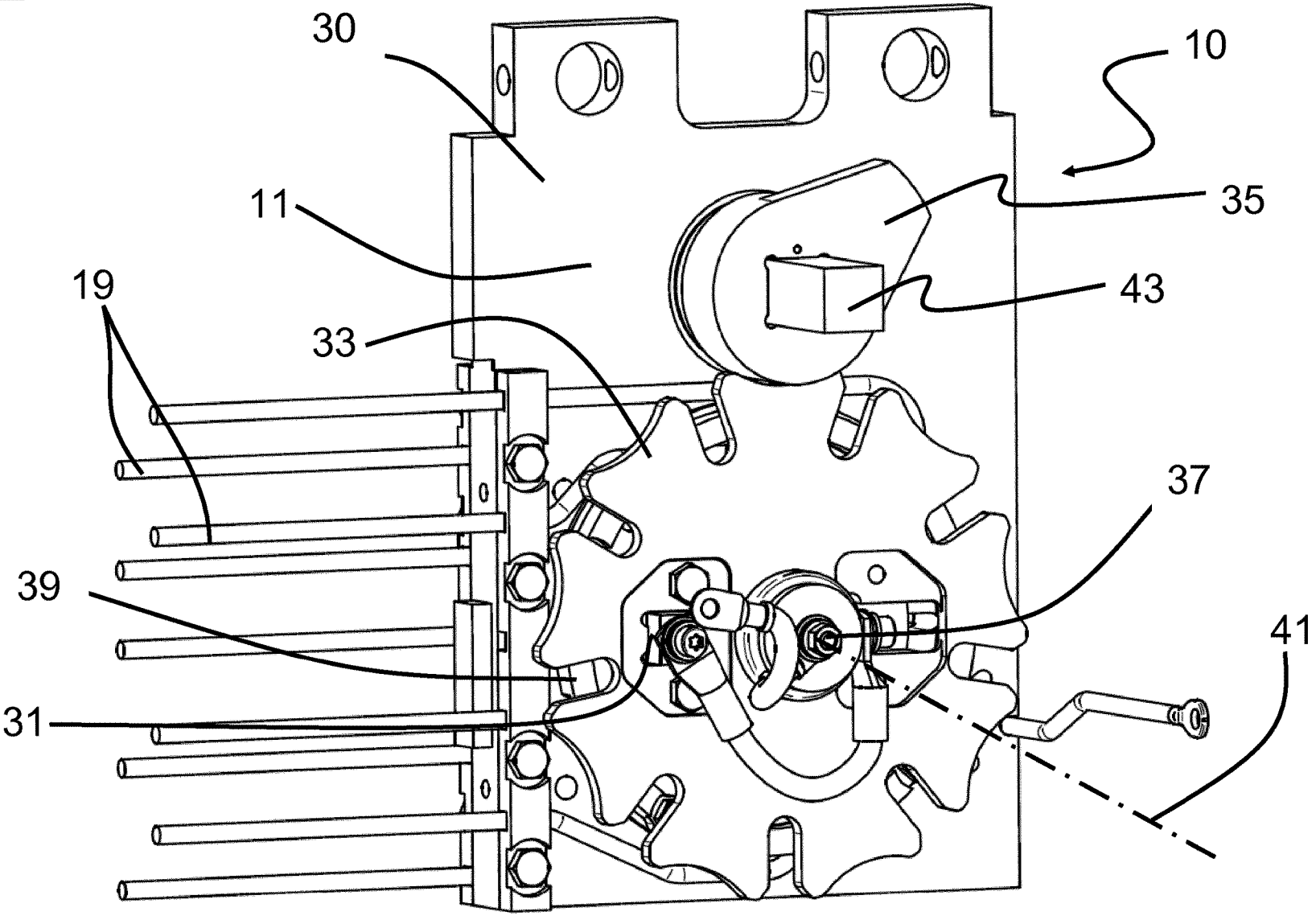
FIG. 2 shows a second side of the selector.

The opposite side of the selector 10 is illustrated in FIG. 2. The fixed contacts 18, which are connected by way of lines 19 with the winding taps 16, can also be seen on the second side 30 of the insulating plate 11. In addition, a second Geneva wheel 23 with a second moved contact 31 is mounted on the second side 30. The second Geneva wheel 33 is mounted on a second bearing axle 34 to be rotatable about the axis 41. A second driver 35 is arranged near the second Geneva wheel 33 and is actuated by the same drive shaft 43 as the first driver 25. In that case, the second driver 35 has a second cam 36, which engages in the second Geneva wheel 33 and thus rotates this.

The first cam 26 is arranged to be offset relative to the second cam 36, or the drivers 25, 35 and thus the cams 26, 36 are arranged to be offset. On rotation of the drive shaft 43 a time-displaced actuation of the Geneva wheels 23, 33 and thus the moved contacts 21, 31 is achieved by the offset arrangement of the cams 26, 36 or drivers 25, 35.

Prior to actuation of the second Geneva wheel 33 the second moved contact 31 always contacts one of the fixed contacts 18 and in that case electrically conductively connects this with a second connection 37 (FIG. 9) of a second branch 13 of the diverter switch 14. On actuation of the selector 10 the second Geneva wheel 33 is rotated and in that case the second moved contact 31 is transferred from the fixed contact 18 to an adjacent fixed contact 18. In the form of embodiment described here the first and second moved contacts 21, 31 contact the same fixed contact 18 before the start of actuation of the selector 10, thus in the static state. However, this can also be varied according to requirements. The contacting of the fixed contacts 18 with the second moved contact 31 takes place on the second side 30 by way of the respective second contact region 32.

Figure 3:
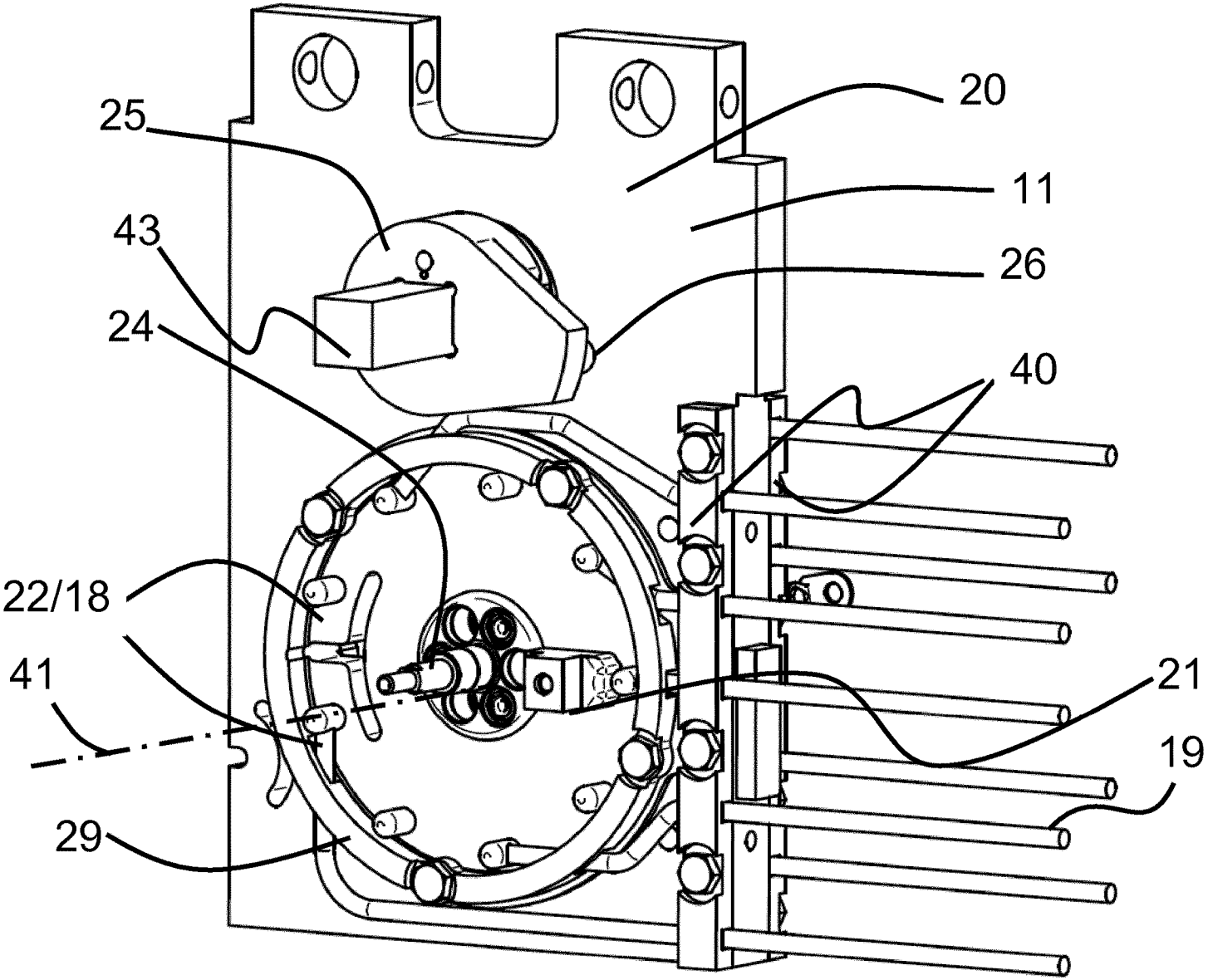
FIG. 3 shows the first side of the selector, from which a first Geneva wheel has been removed, a first form of embodiment of the first moved contact of the selector and a first form of embodiment of the fixed contacts of the selector.

The first side 20 of the selector 10 is again illustrated in FIG. 3, but without the first Geneva wheel 23. Here the fixed contacts 18 with their respective first contact regions 22 can be seen. The lines 19 connecting the fixed contacts 18 with the respective winding tap 16 run in alternation on the first and second sides 20, 30 of the insulating plate 11. As a result, the insulation spacings between the individual lines 19 are increased. The lines 19 are in that case secured to the insulating plate 11 by way of example on the first side 20 by a first retaining ring 29. The securing can, however, also be realised in a different mode and manner. Thus, the lines 19 can be detented in injection-moulded detent contours or snap connections or can be directly integrated in the insulating plate 11 by injection moulding. In the edge region of the insulating plate 11 the lines 19 are, for example, mounted on both sides 20, 30 of the insulating plate 11 by means of additional securing rails 40. The securing of the lines can also be carried out here as previously described by detenting, glueing, etc. The fixed contacts 18 and the lines 19 can, however, also be made from one piece.

Figure 4:
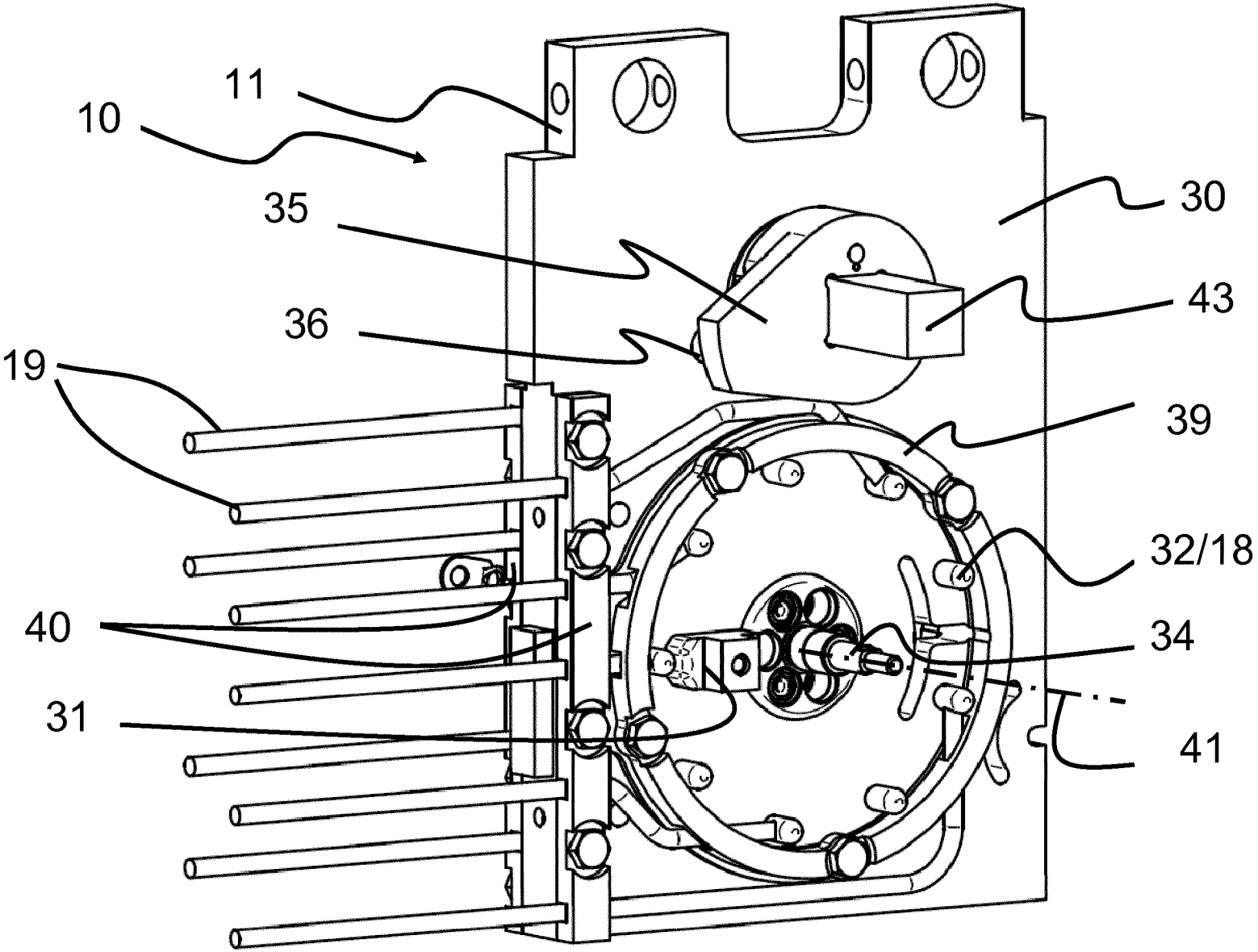
FIG. 4 shows the second side of the selector, from which a second Geneva wheel has been removed, a first form of embodiment of the second moved contact of the selector, and the fixed contacts.

The second side 30 of the selector 10 is again illustrated in FIG. 4, but without the second Geneva wheel 33. The fixed contacts 18 together with their respective second contact regions 32 are illustrated here. The lines 19 are secured to the insulating plate 11 by way of example on the second side 30 by a second retaining ring 39. The securing can, however, also be realised in a different mode and manner. Thus, the lines 19 can be detented in injection-moulded detent contours or snap connections or can be directly integrated in the insulating plate 11 by injection moulding.

Figure 5:
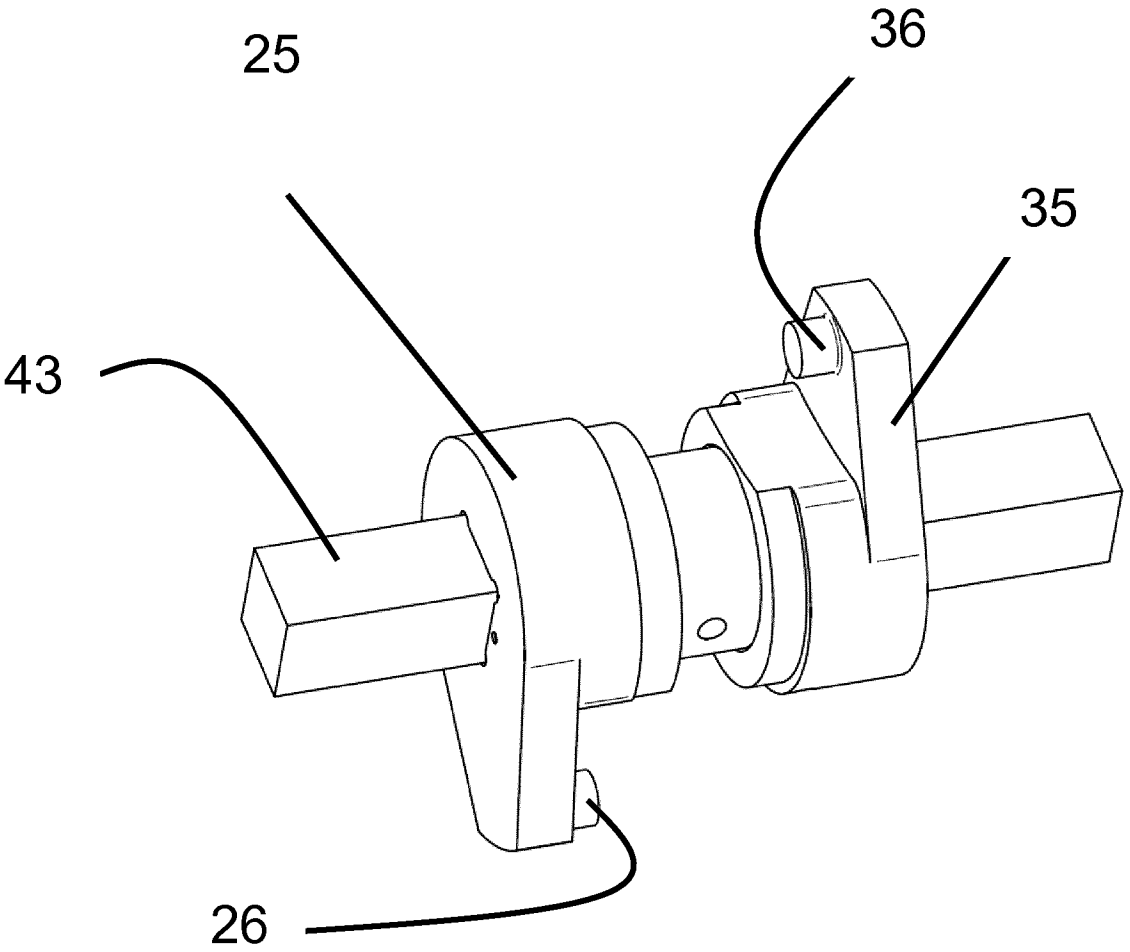
FIG. 5 shows a detail view of drivers of the selector.

The drivers 25, 35 are illustrated in FIG. 5. The cams 26, 36 face one another, but depending on the respective design and operative connection with the respective Geneva wheel 23, 33 can also have a different orientation. It can be readily seen here that the drivers 25, 35 and thus the cams 26, 36 are offset by approximately 180°. Thus, through actuation of the drive shaft 43 the individual Geneva wheels 23, 33 are rotated offset in time and thus the moved contacts 21, 31 actuated at different time instants.

Figure 6:
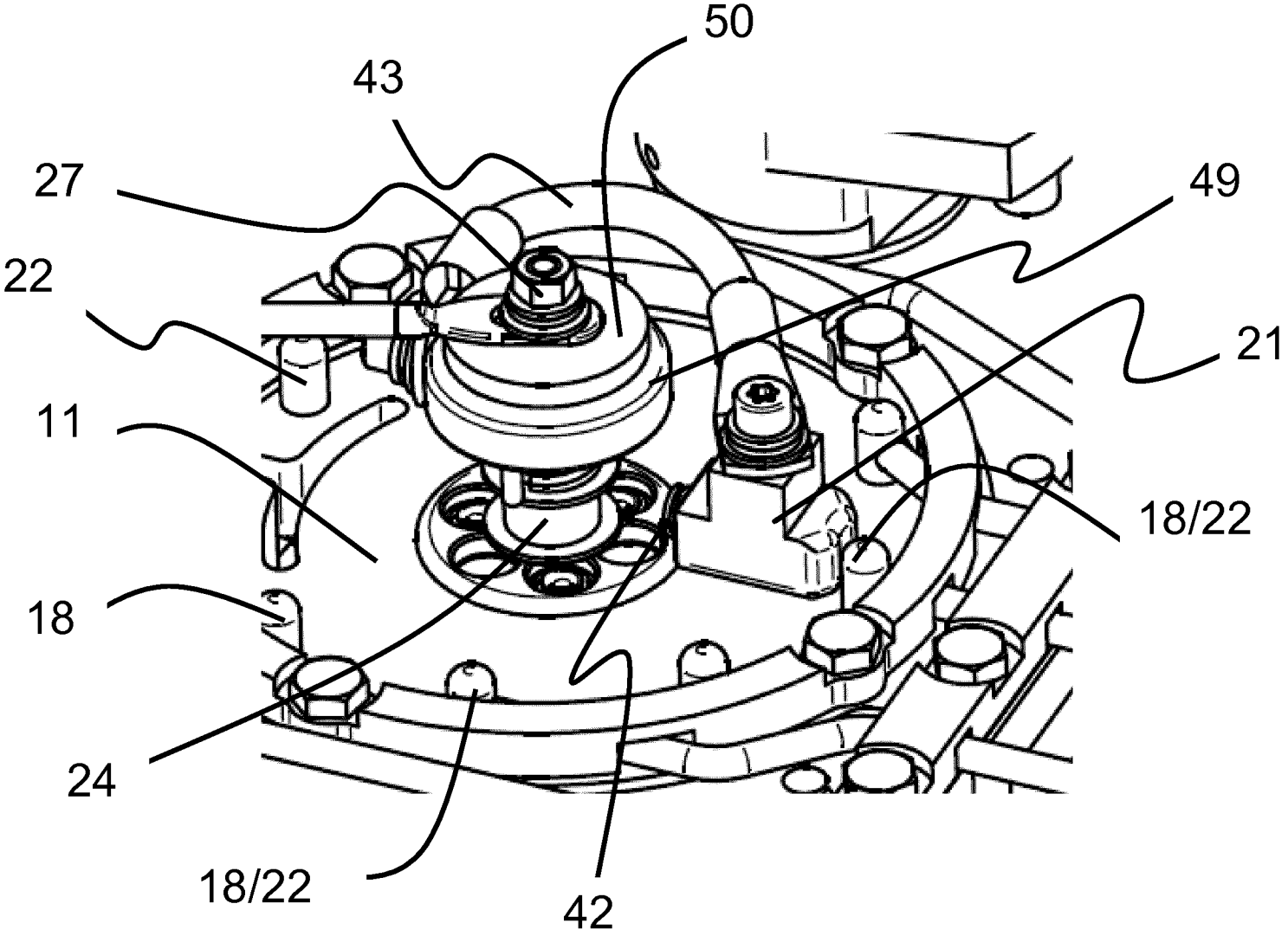
FIG. 6 shows the first form of embodiment of the first moved contact and the first forms of embodiment of the fixed contacts.

The first form of embodiment of the first moved contact 21 and the first form of embodiment of the fixed contacts 18 are illustrated to enlarged scale in FIG. 6. In that case the moved contact 21 is constructed on a front side or contact side thereof in such a way that its contour is optimally matched to the first contact region 22 of the fixed contact 18 and optimally contacts this. The contour of the moved contact 21, 31 in conjunction with the geometry of the fixed contact 18 thus even makes possible a detent function. The moved contact 21 is mounted by means of a compression spring 42 to be resilient and/or floating in the direction of the axis 41. Thus, a contact pressure is always produced when switching over to a fixed contact 18 takes place. The electrically conductive connection between the moved contact 21 and its connection 27 is realised by way of, for example, a wire 44, which is connected with an axial contact 49. The axial contact 49 is fixedly connected by way of an entrainer with the first Geneva wheel 23 and rotates together therewith. The first connection 27 is connected with an electrically conductive, silvered disc 50 arranged to be secure against relative rotation. The disc 50 and the axial contact 49 are electrically conductively connected together in wiping manner. The second moved contact 31, the second contact regions 32 and the second connection 37 are formed on the second side 30 analogously to the first moved contact 21, the first contact regions 22 and the first connection 27.

Figure 7:
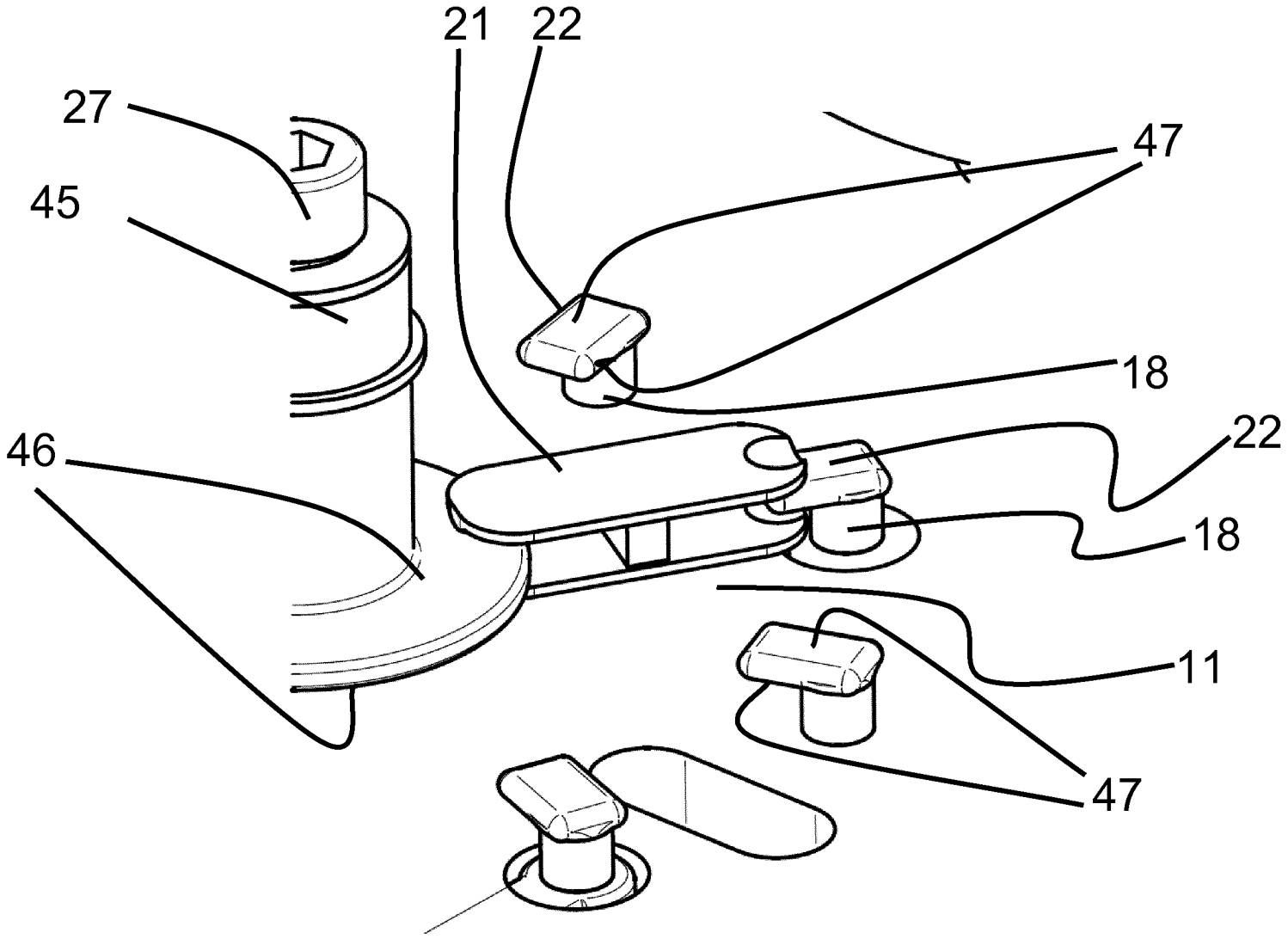
FIG. 7 shows a second form of embodiment of the first moved contact and second forms of embodiments of the fixed contacts.

A detail view of a second form of embodiment of the first moved contact 21 and a second form of embodiment of the fixed contacts 18 is illustrated in FIG. 7. A contact shaft 45 serves as mounting for the first Geneva wheel 23 and contacting means for the first connection 27. The contact shaft 45 has two opposite contact surfaces 46 extending at right angles to the contact shaft 45. Each first contact region 22 has two opposite contact surfaces 47 extending at right angles to the contact shaft 45. These contact surfaces 46, 47 can be respectively contacted in wiping manner individually by a moved contact 21 or by a multi-part moved contact 21. In that case the individual parts of the moved contact 21 are movably mounted in resilient (floating) manner and arranged on the Geneva wheel 23 (not illustrated here) or held by this. In this form of embodiment the moved contact 21 is of intrinsically resilient construction, i.e. the contact force is generated by the biasing of the contact spring plate. The material of which the moved contact consists is, for example, electrically conductive and resilient and preferably $CuSn_6$ or $CuCr_1Zr$.

Figure 8:
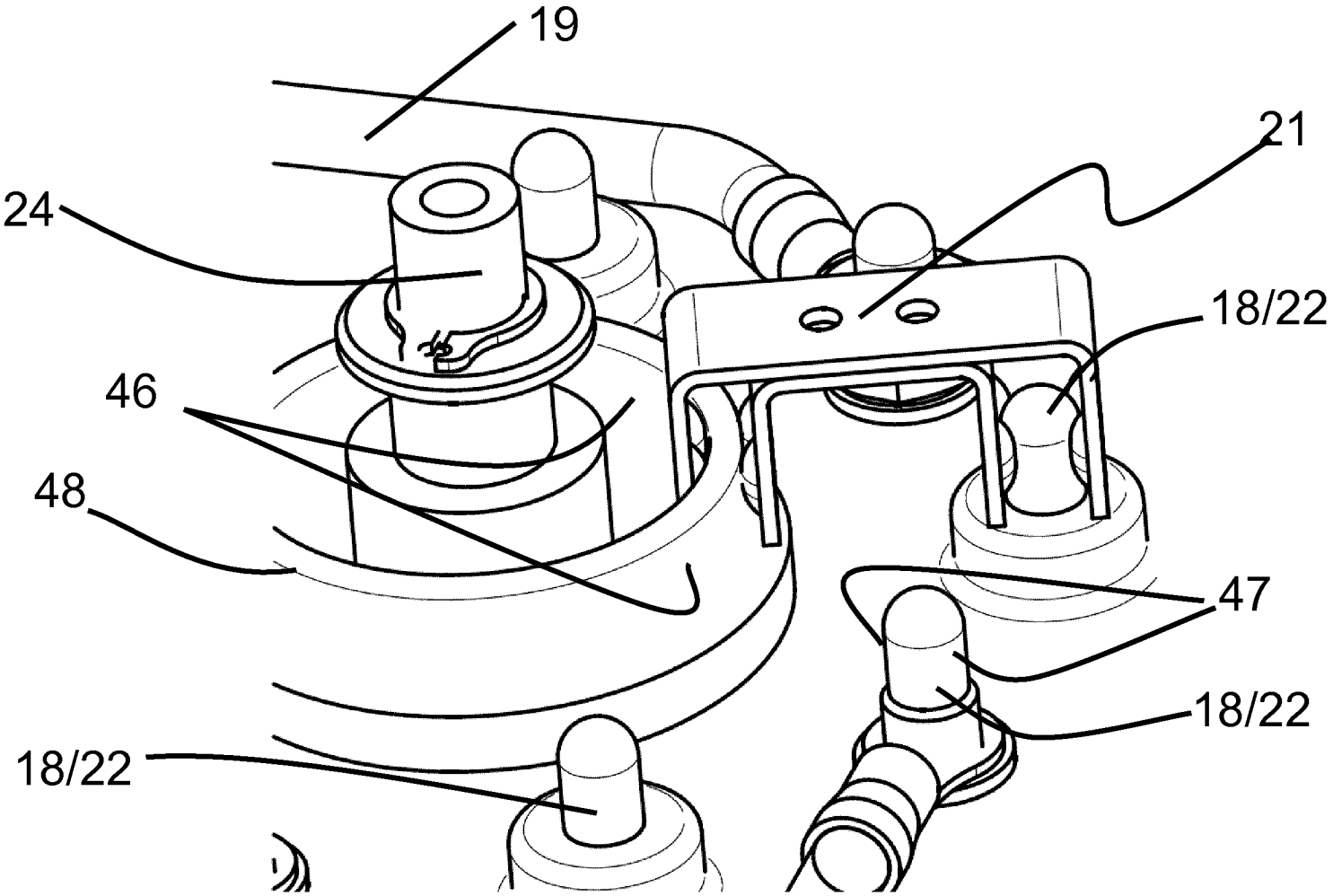
FIG. 8 shows a third form of embodiment of the first moved contact and third forms of embodiment of the fixed contacts.

A detail view of a third form of embodiment of the first moved contact 21 and a third form of embodiment of the fixed contacts 18 is illustrated in FIG. 8. A contact ring 48 serves for the contact-making for the first connection 27. The contact ring 48 has two opposite contact surfaces 46 extending concentrically around the contact shaft 45. Each first contact region 22 has two opposite contact surfaces 47 extending parallel to the contact shaft 45. These contact surfaces 46, 47 can be contacted in wiping manner by the multi-part moved contact 21. In that case, the individual parts of the moved contact 21 are movably mounted in resilient (floating) manner and arranged at the Geneva wheel 23 (not illustrated here). In this form of embodiment the moved contact 21 is of intrinsically resilient construction, i.e. contact force is generated by way of the bias of the contact spring plate. The material of which the moved contact consists is, for example, electrically conductive and resilient and preferably $CuSn_6$ or $CuCr_1Zr$.

Figure 9:
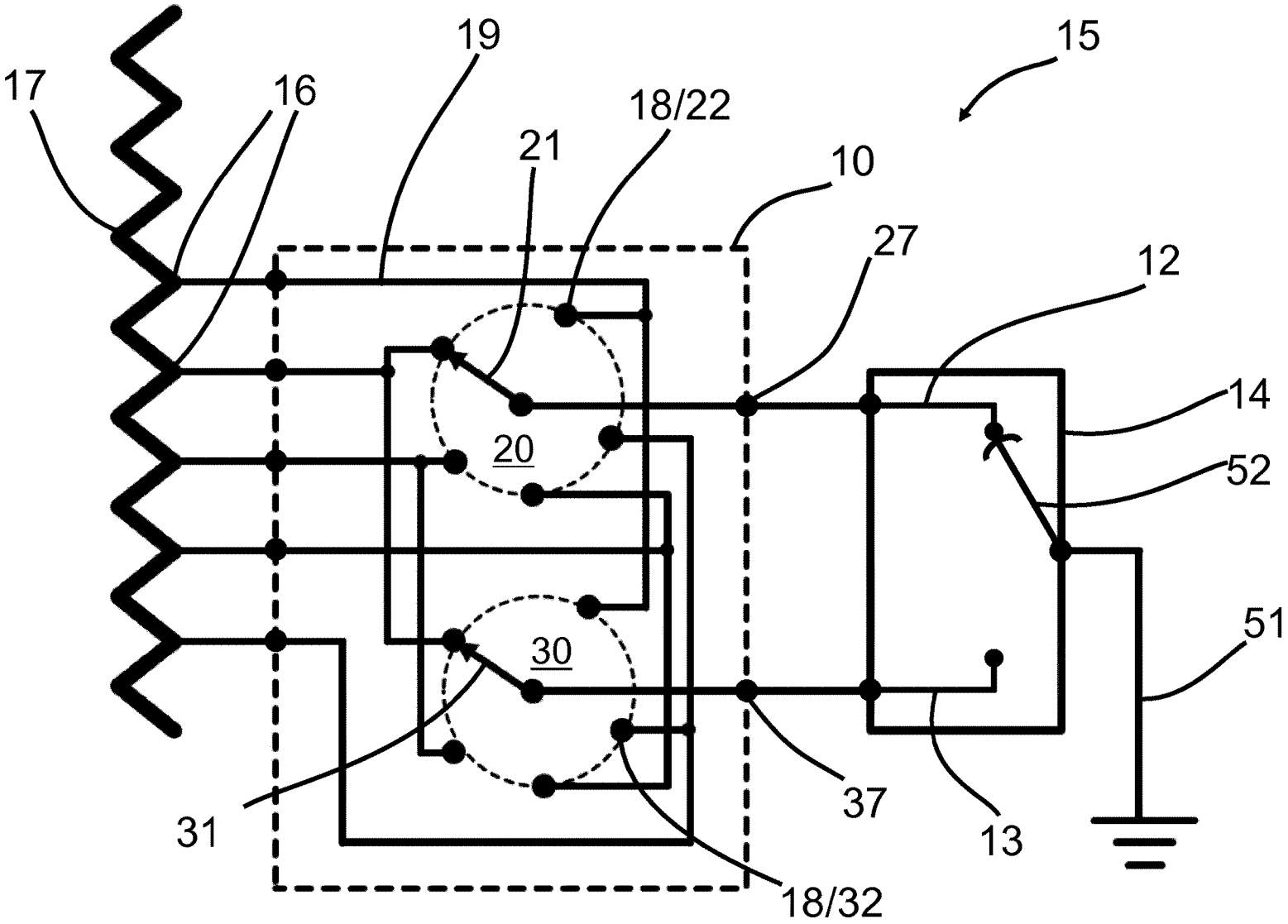
FIG. 9 shows a circuit diagram of an on-load tap changer with diverter switch and selector.

An on-load tap changer 15 with a selector 10 according to the invention and a diverter switch 14 is schematically illustrated in FIG. 9. The selector 10 has a first side 20 and a second side 30 with fixed contacts 18 arranged on a circle. The fixed contacts 18 are electrically conductively connected by way of a line 19 with an associated winding tap 16 of a regulating winding 17 of a regulating transformer. The first moved contact 21 is electrically conductively connected by way of the first connection 27 with the first branch 12 of the diverter switch 14. The second moved contact 31 is electrically conductively connected by way of the second connection 27 with the second branch 13 of the diverter switch 14. In addition, the diverter switch 14 is electrically conductively connected with load diverting means 51 and thus ground potential. Switching over under load takes place in the interior of the diverter switch by way of different switching means 52 from the first branch to the second brand and conversely.

While the invention has been illustrated and described in detail in the drawings and foregoing description, such illustration and description are to be considered illustrative or exemplary and not restrictive. It will be understood that changes and modifications may be made by those of ordinary skill within the scope of the following claims. In particular, the present invention covers further embodiments with any combination of features from different embodiments described above and below. Additionally, statements made herein characterizing the invention refer to an embodiment of the invention and not necessarily all embodiments.

The terms used in the claims should be construed to have the broadest reasonable interpretation consistent with the foregoing description. For example, the use of the article "a" or "the" in introducing an element should not be interpreted as being exclusive of a plurality of elements. Likewise, the recitation of "or" should be interpreted as being inclusive, such that the recitation of "A or B" is not exclusive of "A and B," unless it is clear from the context or the foregoing description that only one of A and B is intended. Further, the recitation of "at least one of A, B and C" should be interpreted as one or more of a group of elements consisting of A, B and C, and should not be interpreted as requiring at least one of each of the listed elements A, B and C, regardless of whether A, B and C are related as categories or otherwise. Moreover, the recitation of "A, B and/or C" or "at least one of A, B or C" should be interpreted as including any singular entity from the listed elements, e.g., A, any subset from the listed elements, e.g., A and B, or the entire list of elements A, B and C.

The following is a list of reference numerals used herein

10 selector
11 insulating plate
12 first branch of 14
—second branch of 14
14 diverter switch
15 on-load tap changer
16 winding tap
17 regulating winding
18 fixed contacts
19 lines
20 first side of 11
21 first moved contact
22 first contact region
23 first Geneva wheel
24 first bearing axle
25 first driver
26 first cam
27 first connection
29 first retaining ring
30 second side of 11
31 second moved contact
32 second contact region
33 second Geneva wheel
34 second bearing axle
35 second driver
36 second cam
37 second connection
39 second retaining ring
40 securing rail
41 axis
42 compression spring
43 drive shaft
44 wire
45 contact shaft
46 contact surfaces of 45
47 contact surfaces of 18
48 contact ring
49 axial contact
50 disc
51 load diverting means of 14
52 switching means of 14

The invention claimed is:

1. A selector for an on-load tap changer with a diverter switch, the selector comprising:

an insulating plate with a first side and a second side, the second side opposite the first side;

a plurality of fixed contacts, which extend from the first side through the insulating plate to the second side;

a first movable contact on the first side;

a second movable contact on the second side;

a first connection, which is connected with the first movable contact and which is connectable with a first branch of the diverter switch; and a second connection, which is connected with the second movable contact and which is connectable with a second branch of the diverter switch;

wherein each of the first moveable contact and the second movable contact are selectably connectable with each of the fixed contacts.

2. The selector according to claim 1, wherein each fixed contact of the fixed contacts has a first contact region for the first movable contact on the first side and a second contact region for the second movable contact on the second side.

3. The selector according to claim 1, further comprising:

a first Geneva wheel, which is mounted on the insulating plate such that it is rotatable about an axis and which carries the first movable contact; and a second Geneva wheel, which is mounted on the insulating plate such that it is rotatable about the axis and which carries the second movable contact, wherein the axis extends perpendicularly to the two sides of the insulating plate.

4. The selector according to claim 3, further comprising:

a first driver on the first side and a second driver on the second side; and a common drive shaft, which extends through the insulating plate and the first driver and the second driver and which is rotatably mounted on the insulating plate, wherein the first driver and the second driver are configured to be driven by the common drive shaft and wherein the first driver has a first cam and the second driver has a second cam; and wherein each of the first cam and the second cam engages in the respective one of the first Geneva wheel or the second Geneva wheel so that for a complete revolution of a respective one of the first driver or the second driver the respective one of the first Geneva wheel or the second Geneva wheel rotates only through a fraction of a complete revolution.

5. The selector according to claim 4, wherein the first cam is configured to be displaced relative to the second cam so that an alternating actuation of the first Geneva wheel and the second Geneva wheel takes place.

6. The selector according to claim 3, wherein each of the first movable contact and the second movable contact is movably mounted on the respective one of the first Geneva wheel of or the second Geneva wheel.

7. The selector according to claim 3, wherein the first Geneva wheel is rotatably mounted on a first bearing axle;

the second Geneva wheel is rotatably mounted on a second bearing axle; and the first bearing axle and the second bearing axles and the insulating plate are of integral construction.

8. The selector according to claim 1, wherein:

the first connection and the second connection are connected with the movable contacts directly or by way of a wire; and/or the first connection and the second connection are connected with a contact shaft and/or a contact ring.

9. The selector according to claim 1, wherein each of the fixed contacts are connected with a line or are constructed integrally with a line as a curved conductor.

10. The selector according to claim 9, wherein for each of the fixed contacts:

the line is secured to the insulating plate by a holding ring and/or a securing rail; and/or the line is clipped to or plugged onto the insulating plate; and/or the line is injection-moulded in or fused into the insulating plate.

11. The on-load tap changer, comprising:

the selector according to claim 1; and the diverter switch with a first branch which is attached to the first connection and a second branch which is attached to the second connection.

* * * * *